US007959038B2

(12) United States Patent
de Oliveira et al.

(10) Patent No.: US 7,959,038 B2
(45) Date of Patent: Jun. 14, 2011

(54) DISPENSING CLOSURE FOR A CONTAINER, AND DISPENSING CONTAINER INCORPORATING SAME

(75) Inventors: Eduardo Martins de Oliveira, São Paulo (BR); Yochiuki Towata, Sao Paulo (BR)

(73) Assignee: Sonoco For-Plas S/A, Sao Paulo (BR)

( * ) Notice: Subject to any disclaimer, the term of this patent is extended or adjusted under 35 U.S.C. 154(b) by 686 days.

(21) Appl. No.: 11/571,677

(22) PCT Filed: Jul. 7, 2005

(86) PCT No.: PCT/BR2005/000125

§ 371 (c)(1),
(2), (4) Date: May 28, 2008

(87) PCT Pub. No.: WO2006/005147

PCT Pub. Date: Jan. 19, 2006

(65) Prior Publication Data

US 2008/0245823 A1 Oct. 9, 2008

(30) Foreign Application Priority Data

Jul. 8, 2004 (BR) ..... 0402934

(51) Int. Cl.
*B65D 88/54* (2006.01)

(52) U.S. Cl. ..... 222/327; 222/326; 222/330; 222/386; 222/391; 222/490; 222/494

(58) Field of Classification Search ..... 222/325–327, 222/490–491, 494, 212, 386, 391, 330; 137/845, 137/849; 220/361, 669, 203.17, 203.18, 89.1; 215/310
See application file for complete search history.

(56) References Cited

U.S. PATENT DOCUMENTS 3,305,143 A 2/1967 Frankenberg
3,884,396 A * 5/1975 Gordon et al. ..... 222/327
(Continued)

FOREIGN PATENT DOCUMENTS

DE 94 06 792 9/1994
(Continued)

OTHER PUBLICATIONS

The International Search Report for PCT Application No. PCT/BR2005/000125; Filed Jul. 7, 2005; Date of Completion Oct. 20, 2005; Date of Mailing Oct. 31, 2005.

*Primary Examiner* — Frederick C. Nicolas
(74) *Attorney, Agent, or Firm* — Alston & Bird LLP

(57) ABSTRACT

A dispensing closure for a dispensing container (1) and a dispensing container (1) incorporating such a dispensing closure, wherein the closure has a unitary type of construction. The dispensing closure includes a generally annular metal ring (4) having an outer peripheral edge and a central opening encircled by an inner peripheral edge (6), the ring being attached to the edge of the container body side wall at one end of the container body; and an overmolded polymer layer (16) having an annular outer portion molded over the inward surface of the ring and having a central panel integrally formed with the outer portion so as to cover the central opening in the ring (4), the central panel of the polymer layer (16) defining at least one aperture (7) through which the product in the container body can be dispensed.

25 Claims, 6 Drawing Sheets

U.S. PATENT DOCUMENTS

| | | | | | |
|---|---|---|---|---|---|
| 4,090,646 | A | * | 5/1978 | Dubiel et al. | 222/326 |
| 4,356,935 | A | * | 11/1982 | Kamin | 222/1 |
| 4,373,646 | A | * | 2/1983 | MacEwen | 222/327 |
| 4,432,473 | A | * | 2/1984 | MacEwen | 222/327 |
| 4,605,129 | A | | 8/1986 | Detzel et al. | |
| 4,681,524 | A | * | 7/1987 | Ikeda et al. | 425/376.1 |
| 4,684,042 | A | * | 8/1987 | Strickler et al. | 222/327 |
| 4,830,231 | A | * | 5/1989 | Smith | 222/327 |
| 5,535,924 | A | * | 7/1996 | Nilsson et al. | 222/153.06 |
| 6,655,554 | B2 | * | 12/2003 | Pantelleria et al. | 222/327 |
| 2009/0039112 | A1 | * | 2/2009 | Robertson et al. | 222/326 |

FOREIGN PATENT DOCUMENTS

| | | |
|---|---|---|
| EP | 0 319 861 | 6/1989 |
| WO | WO 02/083524 | 10/2002 |

* cited by examiner

DISPENSING CLOSURE FOR A CONTAINER, AND DISPENSING CONTAINER INCORPORATING SAME

BACKGROUND OF THE INVENTION

This invention relates to containers in general, and more particularly relates to dispensing containers or cartridges for fluid products, having a slidable plunger for forcing the fluid contents of the cartridge out a dispensing aperture of a closure.

In the restaurant and food preparation industries, and particularly in the fast-food industry, thick or viscous fluid products such as condiments or sauces (e.g., ketchup, mustard, mayonnaise, dairy products, barbecue sauce, and the like) are often contained in tubular cartridges having one end closed by a closure that is formed separately from the cartridge body and is attached to the one end of the body. The closure defines one or more orifices through which the product can be dispensed. The cartridge is loaded into a manual dispensing device or "gun," having a trigger that, when pulled, causes a plunger to be moved within the cartridge (similar to the operation of a caulking gun) and exert pressure on the product in the cartridge so as to force the product out through the one or more orifices in the closure. In this manner, the product can be rapidly dispensed into an individual-serving container or onto a food being prepared.

Various types of closures for such dispensing containers are known. The closure typically includes a metal end that is attached to the container body. A first type of closure includes a stamped metal end having an outer edge that is curled for attachment to one end of the container body, and having a relatively large central opening that is closed by a self-adhesive plastic film adhered to the lower surface of the metal end. The plastic film has one or more openings formed by simple X-shaped cuts, such that the openings open with pressure is exerted on the product in the container, allowing a controlled flow of the product out the opening(s). The openings also close automatically when the pressure on the product is ceased. An removable external membrane seal is also attached to the upper surface of the metal end to seal closed the central opening in the metal end until the user is ready to begin using the container, at which time the user removes the membrane seal.

The above-described type of closure has some drawbacks. For instance, the metal end is stamped from sheet metal that is chemically treated to avoid oxidation, and this treatment includes a layer of varnish to prevent contact between the oxidizable metal of the end and the food product in the container. When the metal end is stamped out to make the central opening, the cut edge exposes the oxidizable metal, and this bare metal edge can come into contact with the food product, which is undesirable. The cut edge also can be sharp and can cause injury to the hand of one using the container. Additionally, in an automated manufacturing process, it can be difficult to precisely position the self-adhesive plastic film on the metal end so that it properly and completely covers the opening in the metal end. Many times, mis-positioning of the film occurs, resulting in an unacceptable container.

Furthermore, the plastic film is thin and hence the four flexible tips or leaves of the film formed by an X-shaped cut do not have sufficient stiffness to form an effective valvular or controlled-flow aperture. The aperture tends to open too easily and quickly when the product is pressurized, and tends to close too slowly when the pressure is released so that the flow of product is not controlled as precisely as desired.

A second type of closure also includes a stamped metal end generally as described above in connection with the first type of closure, and a completely independent piece molded of plastic in the form of a disk. The metal end overlies the plastic disk, and the outer edges of the metal end and plastic disk are together secured to the container body, such as by double-seaming. The plastic disk has one or more X-shaped slits forming controlled-flow apertures. A removable membrane seal is affixed to the upper surface of the metal end to seal closed the opening until the container is to be used, as in the first closure.

This second type of closure has the same drawbacks associated with the metal end as already mentioned for the first type of closure, namely, the cut edge of the metal end is exposed for oxidation and can come into contact with the food product, and the sharp cut edge is a cutting hazard. A further disadvantage of the second type of closure is that it can be difficult to position the metal end and plastic disk simultaneously in the precise position with respect to the container body that is required in order to be properly seamed to the container body. Moreover, because two separate pieces must be manufactured, the cost of the closure is unfavorably impacted. In addition, the metal end and plastic disk together have a combined thickness that is considerable, which detracts from the appearance of the container.

BRIEF SUMMARY OF THE INVENTION

The present invention addresses the above needs and achieves other advantages, by providing a dispensing closure for a dispensing container, and a dispensing container incorporating such a dispensing closure, wherein the closure has a unitary type of construction as opposed to being assembled from separate parts. In accordance with one embodiment of the invention, the dispensing closure comprises a generally annular metal ring having an outer peripheral edge and a central opening encircled by an inner peripheral edge, the ring being attached to the edge of the container body side wall at one end of the container body; and an overmolded polymer layer having an annular outer portion molded over the inward surface of the ring and having a central panel integrally formed with the outer portion so as to cover the central opening in the ring, the central panel of the polymer layer defining at least one aperture through which the product in the container body can be dispensed. The polymer layer can be injection-molded over the metal ring, and may alternatively referred to as an over-injection layer. The metal ring with the overmolded polymer layer thus constitutes a unitary part that does not require any assembling process following its manufacture.

In a further embodiment of the invention, the overmolded polymer layer includes a thickened portion molded so as to envelope the inner peripheral edge of the ring and thereby prevent the inner peripheral edge from being exposed. The cut inner edge of the metal ring thus is not liable to oxidation and is prevented from coming into contact with the product dispensed from the container. Additionally, the inner edge is prevented from cutting a user's hand.

The thickened portion of the polymer layer can extend onto a portion of the outward surface of the metal ring, and can define an outward surface that is spaced above the outward surface of the metal ring. This outward surface of the thickened portion can form a surface for the attachment of a removable membrane seal. The membrane seal can be heat-sealed to the outward surface of the thickened portion of the polymer layer.

The metal ring can define one or more attachment features or interlock features for enhancing the mechanical interlocking of the metal ring and the polymer layer at the inner peripheral edge of the ring. In one embodiment, the metal ring defines one or more apertures spaced radially outward of the inner peripheral edge, and the material of the polymer layer extends through the aperture(s). There can be a plurality of such apertures encircling the inner peripheral edge and circumferentially spaced apart from one another. Additionally or alternatively, the metal ring can be shaped at its inner peripheral edge so that it is non-planar and thereby interlocks with the polymer layer enveloping it. As one example, the inner peripheral edge can be an angle section defining an included angle greater than 90 degrees. Alternatively, the inner edge could be curled or otherwise shaped.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
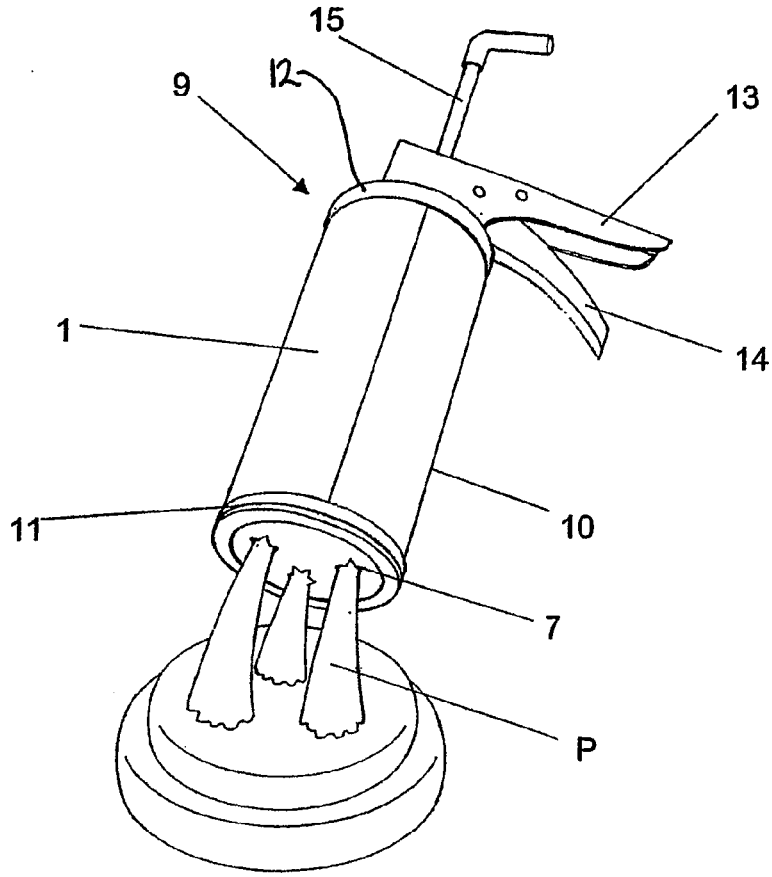
FIG. 1 is a perspective view illustrating a mechanical device in the form of a gun being used in conjunction with a dispensing container in accordance with the present invention.
Figure 2:
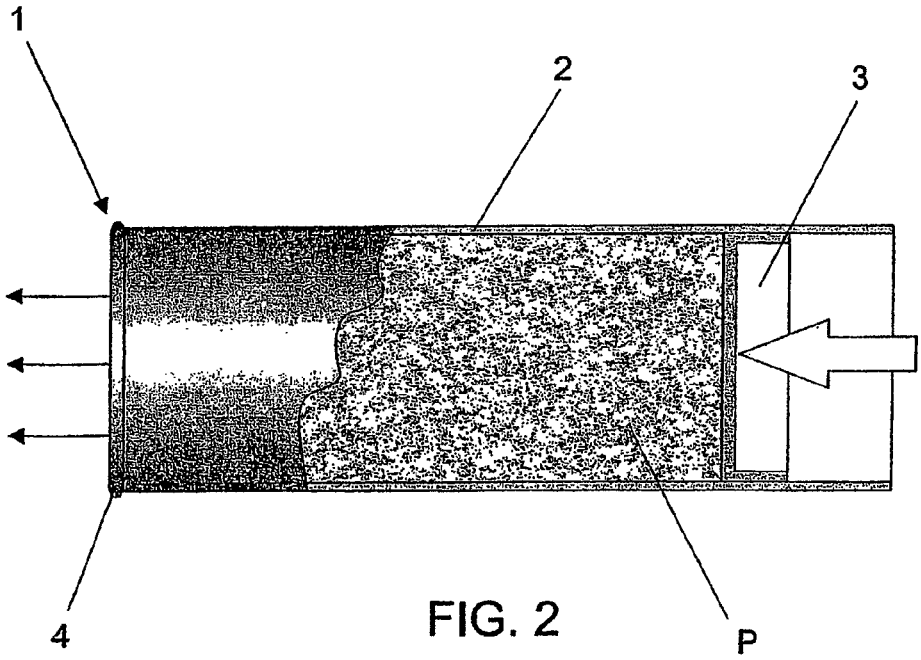
FIG. 2 is a side view, partly in section, of a dispensing container in accordance with one embodiment of the invention.
Figure 3:
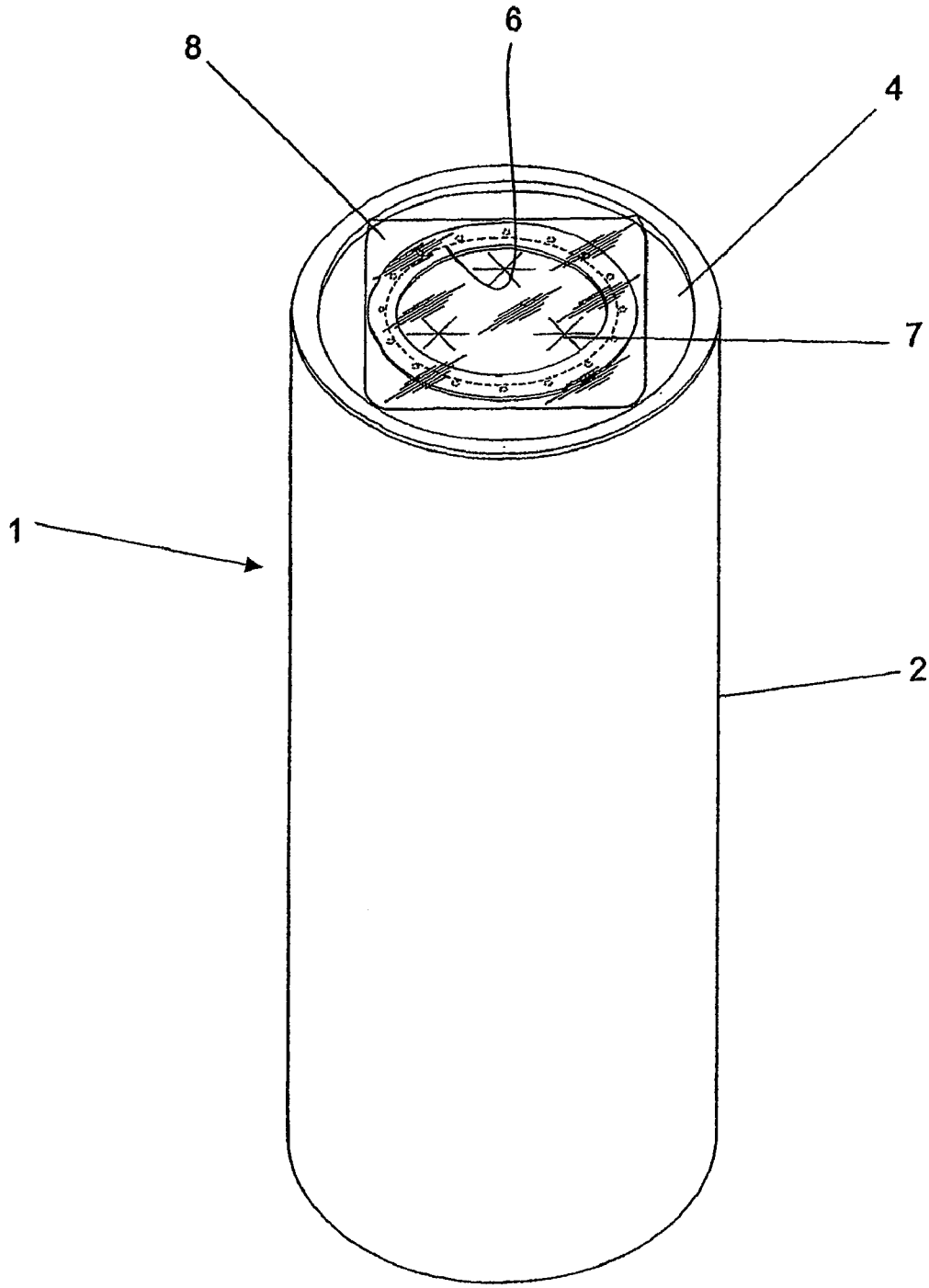
FIG. 3 is a perspective view of a fully assembled dispensing container in accordance with one embodiment of the invention.

With initial reference to FIGS. 1 through 3, a dispensing container 1 in accordance with one embodiment of the invention is illustrated. In FIG. 1, the container 1 is shown being used in a mechanical device or dispensing gun 9 that includes a semi-cylindrical berth 10 for receiving the generally cylindrical dispensing container 1. The gun 9 also includes a circular ring-shaped front member 11 affixed to a forward end of the berth 10 and a circular rear member 12 affixed to a rear end of the berth, which are positioned such that the dispensing container 1 is disposed between the front member 11 and the rear member 12.

As shown in FIG. 2, the dispensing container 1 includes a tubular container body 2, a dispensing closure including a metal ring 4 attached to one end of the container body, and a plunger 3 slidably mounted within the container body proximate the other end of the container body. A thick or viscous fluid product P, such as a condiment (e.g., ketchup, mayonnaise, mustard, diary product, sauce, or the like), is contained within the container body between the metal ring 4 and the plunger 3. When the plunger 3 is axially advanced toward the metal ring 4, the product P is put under pressure and is forced out through apertures 7 in the closure as described in greater detail below.

Again referring to FIG. 1, the dispensing gun 9 includes a handle 13 and a trigger 14 pivotally connected to the handle and berth, and a connecting rod 15 operatively coupled to the trigger so that when the trigger is pulled through a defined range of motion, the connecting rod is advanced toward the front member 11 of the gun by a predetermined distance. The movement of the connecting rod causes the plunger 3 in the container 1 to be axially advanced so as to force a quantity of the contained product out the apertures 7 of the closure.

Figure 4:
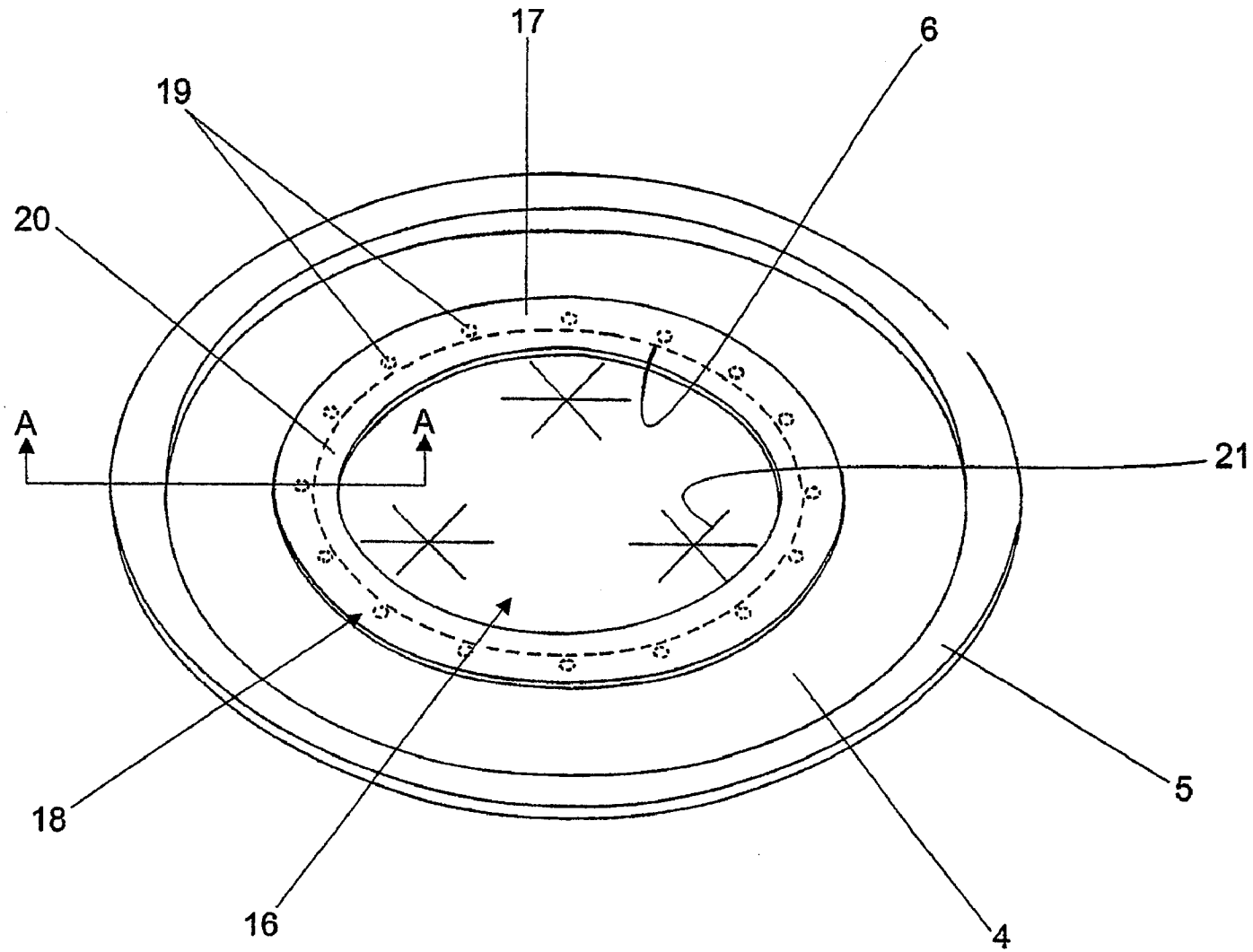
FIG. 4 is a perspective view of a dispensing closure in accordance with one embodiment of the invention.
Figure 5:
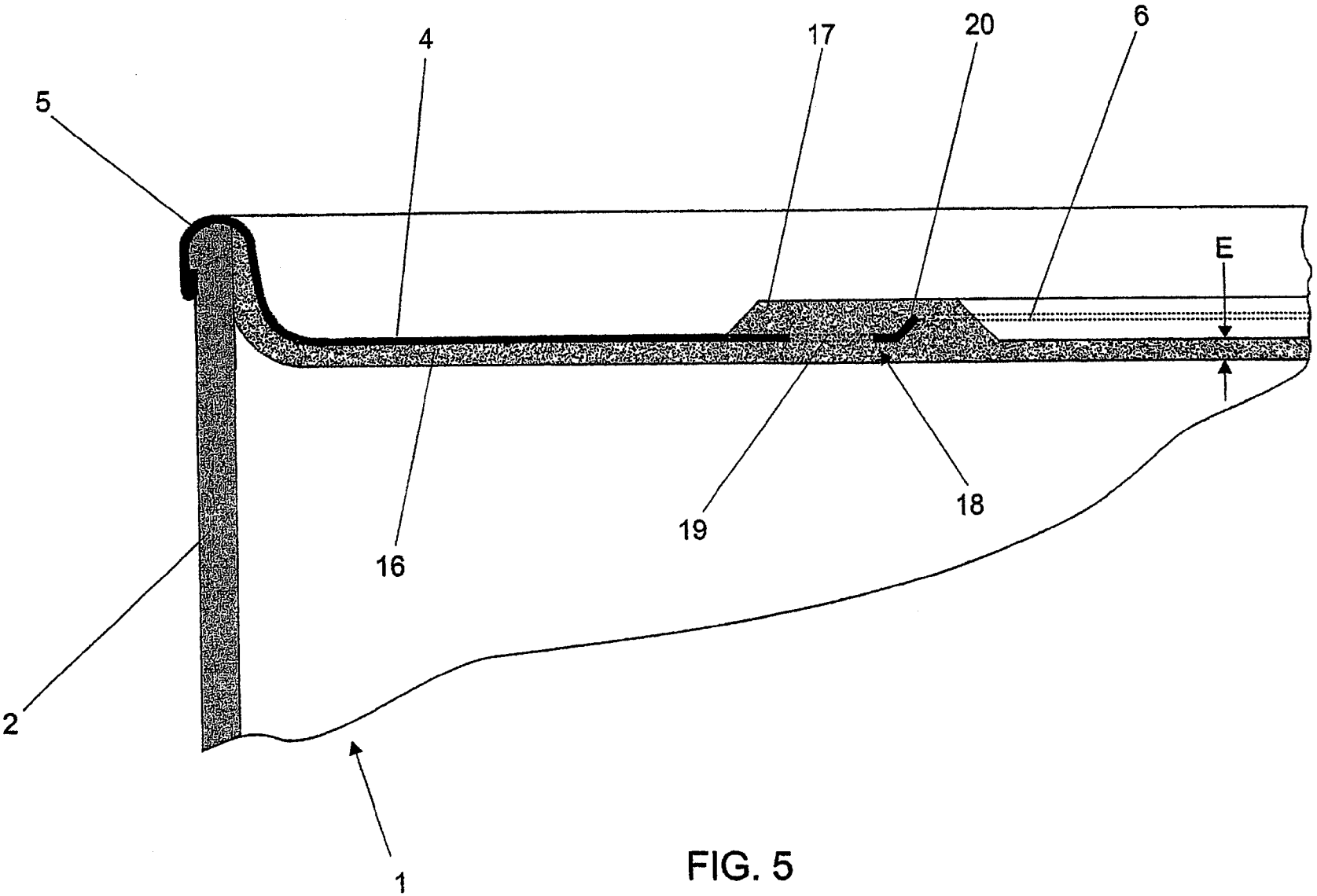
FIG. 5 is an enlarged cross-sectional view of the dispensing closure of FIG. 4.
Figure 6:
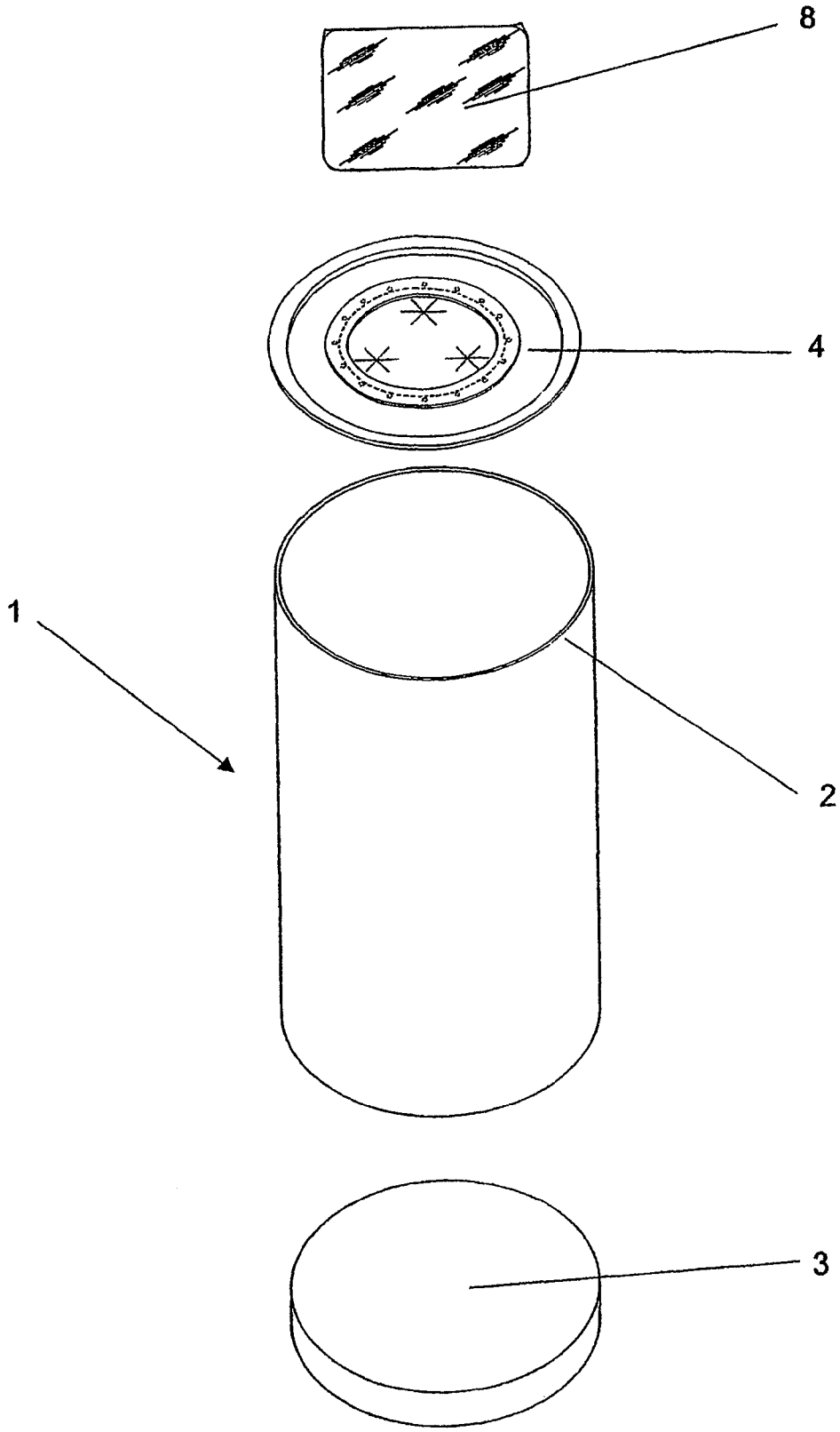
FIG. 6 is an exploded view of a dispensing container in accordance with one embodiment of the invention.
Figure 7:
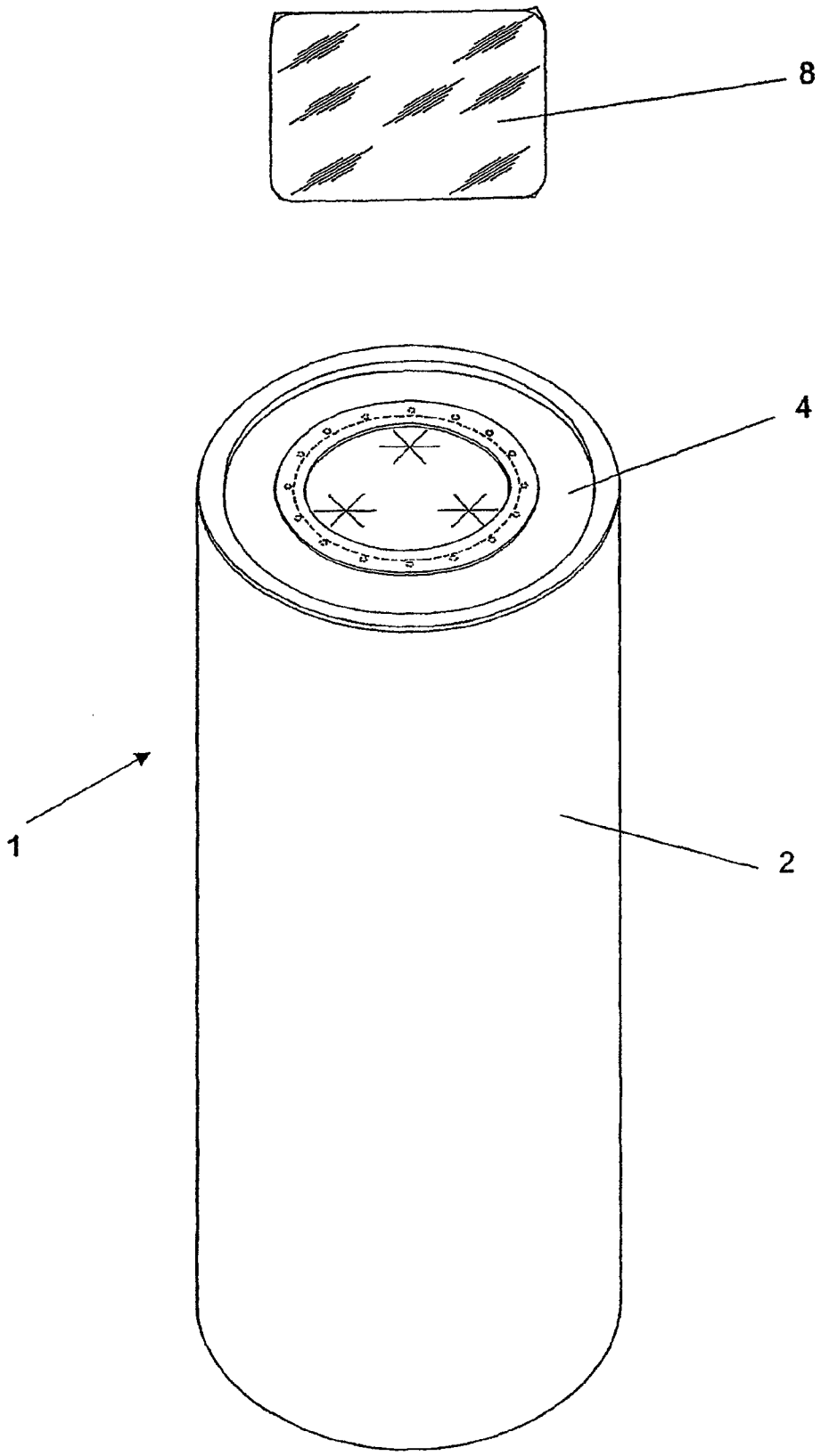
FIG. 7 is a view similar to FIG. 6, wherein only the removable membrane seal is shown exploded.

Details of the dispensing closure in accordance with one embodiment of the invention are now described with reference to FIGS. 3 through 7. The dispensing closure includes a metal ring 4 of generally annular configuration. At the outer peripheral edge of the ring 4, a curled portion 5 is formed. As best depicted in FIG. 5, the curled portion 5 defines a generally annular channel that receives the edge of the wall of the container body 2. The ring is affixed to the edge of the container body in any suitable manner providing a sealed connection therebetween; for example, the ring and the edge of the container body can be double-seamed, or another suitable technique can be used. The metal ring 4 has a large central opening encircled by an inner peripheral edge 6 of the ring. An overmolded or over-injection polymer layer 16 is molded over the inward-facing surface of the metal ring 4, forming a closing layer that closes the central opening of the ring. The polymer layer 16 can cover less than all of the inward surface of the ring, i.e., the polymer layer does not have to extend radially outwardly to the outer edge of the ring, but can terminate short of the outer edge. As shown in FIG. 5, the polymer layer 16 can extend at least partially into the curled portion 5 such that the polymer layer makes contact with the container body 2; the polymer layer can be seamed, along with the curled portion 5, to the container body, if desired. The central panel of the polymer layer 16, which lies radially inward of the inner edge 6 of the metal ring, defines one or more apertures 7 through which product is dispensed.

With particular reference to FIG. 5, the polymer layer 16 is molded such that it envelopes the inner edge 6 of the metal ring. More particularly, the polymer layer 16 includes a thickened portion 17 that extends onto a portion of the outward surface of the metal ring 4, such that a region of the metal ring adjacent the inner edge 6 is completely enveloped in the polymer material of the thickened portion 17. The thickened portion 17 can have the shape of an annular ring as been seen in FIG. 4. The upper or outward surface of the thickened portion 17 can be planar as shown, or non-planar. This outward surface of the thickened portion 17 can serve as a surface for the attachment of a removable membrane seal 8 (FIG. 3) that seals the dispensing closure until the container is ready to be used for dispensing product. The outward surface of the thickened portion 17 is spaced above the outward surface of the metal ring 4.

The metal ring 4 preferably also defines one or more features for enhancing the mechanical connection between the ring and the polymer layer 16. In the illustrated embodiment, these features include one or more apertures 19 formed through the ring proximate the inner edge 6. As shown in FIG. 4, the apertures 19 can be arranged in a row that encircles the inner edge 6. The material of the thickened portion 17 of the polymer layer extends through the apertures 19 and thereby interlocks with the ring. Additionally or alternatively, the ring 4 can include a non-planar portion at the inner edge 6 for interlocking with the enveloping polymer material. For instance, the non-planar portion can be an angle section or fold 20 having two portions of the metal forming an included angle therebetween, the included angle preferably being greater than 90 degrees. However, the configuration of the interlocking features 19, 20 can be varied in many different ways; the invention is not limited to any particular interlocking arrangement.

Preferably, the thickness E of the central panel of the polymer layer 16 is substantially equal to the thickness of the outer annular portion of the polymer layer that is molded onto the inward surface of the metal ring 4, and the central panel is substantially co-planar with the outer annular portion. Alternatively, the thickness E of the central panel can be greater than that of the outer annular portion of the polymer layer; the thickness increase can take place either outwardly or inwardly, or both.

The apertures 7 for the dispensing of product can each be formed by two or more intersecting slits 21 (FIG. 4). In the illustrated embodiment, each aperture is formed by three intersecting slits 21 spaced 60° apart, thus forming six triangular flaps or leaves, but a greater number of slits (e.g., 5 or 6 or more) can alternatively be used. When the contained product is pressurized by advancing the plunger 3, the pressure causes the leaves to be deformed outwardly. The material of the polymer layer 16 is resiliently flexible, and the deformation of the leaves is elastic; thus, a restoring force tends to want to move the leaves back to their undeformed position co-planar with the polymer layer. In this manner, the aperture 7 acts as a membrane valve and controls the flow of the product. Additionally, when the pressure on the product is released, the leaves return substantially to their undeformed positions, closing the aperture. The apertures 7 thus are self-closing.

The apertures 7 advantageously are formed after the manufacture of the closure, i.e., after the overmolding of the polymer layer 16 onto the metal ring 4, in a separate operation, as opposed to molding the apertures into the polymer layer. The advantage thus obtained is that greater flexibility is attained, in that it is possible to produce large quantities of identical closures without apertures, and thereafter the apertures can be formed in the configurations required in each different application of the closure. For instance, each different product can have different viscosity such that apertures that are suitable for one product may be inappropriate for a different product. In accordance with the invention, the apertures can be tailored to the particular product, and it does not require different mold tooling in order to do so.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container for dispensing a fluid product contained in the container, comprising:

a container body having a tubular side wall and an opening at each end of the container body, the opening at each end being circumscribed by an edge of the side wall; and a dispensing closure comprising:

an annular metal ring having an outer peripheral edge and a central opening defining an inner peripheral edge, the ring being attached to the edge of the side wall at one end of the container body, the ring having an inward surface facing an interior of the container body and an opposite outward surface; and a polymer layer having an annular outer portion molded over the inward surface of the ring and having a central panel integrally formed with the outer portion so as to cover the central opening in the ring, the central panel of the polymer layer defining at least one aperture through which the product in the container body can be dispensed, wherein a thickened portion of the polymer layer envelopes the inner peripheral edge of the ring and thereby prevents the inner peripheral edge from being exposed.

2. The container of claim 1, wherein the thickened portion of the polymer layer extends onto a portion of the outward surface of the ring proximate the inner peripheral edge.

3. The container of claim 2, wherein the ring includes one or more apertures spaced radially outward of the inner peripheral edge of the ring through which the material of the thickened portion of the polymer layer extends.

4. The container of claim 2, wherein the thickened portion of the polymer layer has an outward surface spaced above the outward surface of the metal ring.

5. The container of claim 4, further comprising a removable membrane seal attached to the outward surface of the thickened portion of the polymer layer.

6. The container of claim 2, wherein a portion of the ring adjacent the inner peripheral edge, which portion is enveloped in the thickened portion of the polymer layer, is shaped to be non-planar so as to interlock with the thickened portion.

7. The container of claim 6, wherein the portion of the ring that is non-planar at the inner peripheral edge is an angle section defining an included angle greater than 90 degrees.

8. The container of claim 1, wherein the central panel of the polymer layer is co-planar with and has about the same thickness as the outer portion of the polymer layer.

9. The container of claim 1, wherein the aperture in the central panel of the polymer layer comprises a self-closing aperture that tends to close and prevent product from exiting through the aperture when the product is non-pressurized.

10. The container of claim 9, wherein the central panel of the polymer layer defines a plurality of said self-closing apertures.

11. The container of claim 1, further comprising a removable membrane seal attached to an outward surface of the polymer layer for sealing closed the at least one aperture.

12. The container of claim 1, further comprising a plunger closing the opposite end of the container body from the end having the dispensing closure, the plunger being axially slidable in the container body for forcing product out the at least one aperture in the polymer layer.

13. A container for dispensing a fluid product contained in the container, comprising:

a container body having a tubular side wall and an opening at each end of the container body, the opening at each end being circumscribed by an edge of the side wall; and a dispensing closure comprising:

an annular metal ring having an outer peripheral edge and a central opening defining an inner peripheral edge, the ring being attached to the edge of the side wall at one end of the container body, the ring having an inward surface facing an interior of the container body and an opposite outward surface; and a polymer layer having an annular outer portion molded over the inward surface of the ring and having a central panel integrally formed with the outer portion so as to cover the central opening in the ring, the central panel of the polymer layer defining at least one aperture through which the product in the container body can be dispensed;

wherein the ring includes a curled rim adjacent the outer peripheral edge, the curled rim defining an annular channel for receiving the edge of the container body, and the outer portion of the polymer layer extends partially into the channel for contacting an inner surface of the container body.

14. A dispensing closure for a tubular container body having a tubular side wall and an opening at each end of the container body, the opening at each end being circumscribed by an edge of the side wall, the dispensing closure comprising:

an annular metal ring having an outer peripheral edge and a central opening defining an inner peripheral edge, the ring structured and arranged to be attached to the edge of the side wall at one end of the container body, the ring having an inward surface for facing an interior of the container body and an opposite outward surface; and a polymer layer having an annular outer portion molded onto the inward surface of the ring and having a central panel integrally formed with the outer portion so as to cover the central opening in the ring, the central panel of the polymer layer defining at least one aperture through which a fluid product in the container body can be dispensed, wherein the polymer layer includes a thickened portion molded so as to envelope the inner peripheral edge of the ring so as to prevent the inner peripheral edge from being exposed.

15. The dispensing closure of claim 14, wherein the thickened portion of the polymer layer extends onto a portion of the outward surface of the ring proximate the inner peripheral edge.

16. The dispensing closure of claim 15, wherein the ring includes one or more apertures spaced radially outward of the inner peripheral edge of the ring through which the material of the thickened portion of the polymer layer extends.

17. The dispensing closure of claim 14, wherein a portion of the ring adjacent the inner peripheral edge, which portion is enveloped in the thickened portion of the polymer layer, is shaped to be non-planar so as to interlock with the thickened portion.

18. The dispensing closure of claim 17, wherein the portion of the ring that is non-planar at the inner peripheral edge is an angle section defining an included angle greater than 90 degrees.

19. The dispensing closure of claim 14, wherein the thickened portion of the polymer layer has an outward surface spaced above the outward surface of the metal ring.

20. The dispensing closure of claim 19, further comprising a removable membrane seal attached to the outward surface of the thickened portion of the polymer layer.

21. The dispensing closure of claim 14, wherein the central panel of the polymer layer is co-planar with and has about the same thickness as the outer portion of the polymer layer.

22. The dispensing closure of claim 14, wherein the ring includes a curled rim adjacent the outer peripheral edge, the curled rim defining an annular channel for receiving the edge of the container body, and the outer portion of the polymer layer extends partially into the channel for contacting an inner surface of the container body.

23. The dispensing closure of claim 14, wherein the aperture in the central panel of the polymer layer comprises a self-closing aperture that tends to close and prevent product from exiting through the aperture when the product is non-pressurized.

24. The dispensing closure of claim 23, wherein the central panel of the polymer layer defines a plurality of said self-closing apertures.

25. The dispensing closure of claim 14, further comprising a removable membrane seal attached to an outward surface of the polymer layer for sealing closed the at least one aperture.

* * * * *